US008864554B2

(12) United States Patent
Masalin et al.

(10) Patent No.: US 8,864,554 B2
(45) Date of Patent: Oct. 21, 2014

(54) SHARPENER

(75) Inventors: Petteri Masalin, Helsinki (FI); Juha Huhtala, Karjaa (FI); Kari Kunnas, Rekijoki (FI); Aaro Huttunen, Billnäs (FI); Jouni Salojärvi, Helsinki (FI); Sami Lyytikäinen, Lohja (FI); Olli-Pekka Vänttilä, Lohja (FI)

(73) Assignee: Fiskars Brands Finland Oy Ab, Billnas (FI)

( * ) Notice: Subject to any disclaimer, the term of this patent is extended or adjusted under 35 U.S.C. 154(b) by 163 days.

(21) Appl. No.: 13/599,888

(22) Filed: Aug. 30, 2012

(65) Prior Publication Data

US 2013/0095736 A1 Apr. 18, 2013

(30) Foreign Application Priority Data

Sep. 1, 2011 (FI) ..... 20115856
Dec. 22, 2011 (FI) ..... 20116306

(51) Int. Cl.
*B24B 3/54* (2006.01)
*B24D 15/08* (2006.01)

(52) U.S. Cl.
CPC ..... *B24B 3/54* (2013.01); *B24D 15/082* (2013.01)
USPC ..... 451/545; 451/558; 451/349; 451/229; 451/293; 451/65

(58) Field of Classification Search
CPC .. B24D 15/082; B24D 15/065; B24D 15/066; B24D 18/00; B24D 5/04; B24B 3/34; B24B 3/54; B23D 63/001; B23D 63/003; B26D 1/143
USPC ..... 451/545, 558, 349, 45, 229, 293, 461, 451/65
See application file for complete search history.

(56) References Cited

U.S. PATENT DOCUMENTS 1,753,510 A * 4/1930 Gibson ..... 472/121
1,767,091 A 6/1930 Millsap
(Continued)

FOREIGN PATENT DOCUMENTS

CN 201052586 4/2008
EP 0 578 985 A1 1/1994
(Continued)

OTHER PUBLICATIONS

U.S. Appl. No. 29/414,295, filed Feb. 27, 2012, Masalin et al.
(Continued)

*Primary Examiner* — George Nguyen
(74) *Attorney, Agent, or Firm* — Foley & Lardner LLP

(57) ABSTRACT

The invention relates to a sharpener for sharpening a cutting tool, such as a knife, the sharpener comprising a body part (1), a rotatable sharpening roll (2) resting on the body part, and a first guide groove (11) above the sharpening roll for receiving a first tool blade and for guiding it in relation to the sharpening roll (2). To allow the sharpener to be made structurally simple and well applicable for sharpening both narrow and wide blades, the sharpener comprises a second guide groove (14), which is wider than the first guide groove (11), to be arranged above the sharpening roll (2) to allow a second tool blade to be received and guided in relation to the sharpening roll (2).

19 Claims, 4 Drawing Sheets

(56) References Cited

U.S. PATENT DOCUMENTS

| | | | | | |
|---|---|---|---|---|---|
| D111,174 | S | | 9/1938 | Carpenter | |
| D132,775 | S | | 6/1942 | Case | |
| 2,431,188 | A | * | 11/1947 | Miller | 451/486 |
| 2,448,629 | A | | 9/1948 | Schmidt | |
| 2,457,714 | A | | 12/1948 | Pancoast | |
| 2,495,814 | A | * | 1/1950 | Marcantonio | 76/87 |
| 2,544,777 | A | * | 3/1951 | Cahil | 451/545 |
| D170,728 | S | | 10/1953 | Tavolozzi | |
| D172,371 | S | | 6/1954 | Tavolozzi | |
| 2,749,678 | A | * | 6/1956 | Jahn | 451/461 |
| 2,775,075 | A | * | 12/1956 | McMaster et al. | 451/241 |
| 2,841,926 | A | | 7/1958 | Lebus | |
| 4,228,703 | A | | 10/1980 | Moss | |
| D287,095 | S | | 12/1986 | Hunter | |
| 4,696,129 | A | | 9/1987 | Roberts | |
| 4,723,375 | A | | 2/1988 | Linden | |
| 4,807,399 | A | * | 2/1989 | Friel | 451/45 |
| 4,897,965 | A | | 2/1990 | Friel | |
| 4,928,436 | A | * | 5/1990 | Linden | 451/192 |
| 5,005,319 | A | | 4/1991 | Friel | |
| D322,169 | S | | 12/1991 | Mietelski | |
| D352,880 | S | | 11/1994 | Anderson | |
| D372,180 | S | | 7/1996 | Powell | |
| D372,580 | S | | 8/1996 | Chipman, Sr. | |
| 5,620,359 | A | * | 4/1997 | Harrison et al. | 451/45 |
| 5,868,611 | A | | 2/1999 | Friel | |
| 6,012,971 | A | * | 1/2000 | Friel et al. | 451/45 |
| 6,039,642 | A | | 3/2000 | Collins | |
| 6,398,633 | B1 | * | 6/2002 | Lothe | 451/545 |
| 6,802,763 | B1 | * | 10/2004 | Leung | 451/267 |
| 6,846,229 | B1 | | 1/2005 | Ranieri | |
| 6,866,569 | B2 | * | 3/2005 | Cozzini | 451/349 |
| 6,875,093 | B2 | | 4/2005 | Friel et al. | |
| D509,355 | S | | 9/2005 | Pleskunas | |
| 7,235,004 | B2 | | 6/2007 | Friel et al. | |
| D550,532 | S | | 9/2007 | Radocy | |
| 8,221,199 | B2 | | 7/2012 | Smith | |
| 2005/0221742 | A1 | | 10/2005 | Su | |
| 2007/0281590 | A1 | * | 12/2007 | Friel et al. | 451/45 |
| 2009/0064822 | A1 | | 3/2009 | Sterngold | |
| 2009/0209177 | A1 | | 8/2009 | Walker | |
| 2009/0233530 | A1 | | 9/2009 | Friel et al. | |
| 2012/0270481 | A1 | | 10/2012 | Smith | |

FOREIGN PATENT DOCUMENTS

| | | |
|---|---|---|
| GB | 2 123 323 | 2/1984 |
| GB | 2 141 953 | 1/1985 |
| WO | WO-2011/112924 | 9/2011 |

OTHER PUBLICATIONS

Fiskars Xsharp Axe and Knife Sharpener. Downloaded from http://en.reddot.org/2839.html?&cHash=f2c541eb338383dd308b11037ac8cf17&detail= . . . Dec. 11, 2012, 1 page.

European Search Report for Application No. 12182581.4, dated Aug. 19, 2014, 6 pages.

* cited by examiner

SHARPENER

This application claims the benefit of Finnish Patent Application No. 20115856, filed Sep. 1, 2011 and Finnish Patent Application No. 20116306, filed Dec. 22, 2011, both of which are incorporated herein by reference in their entireties.

BACKGROUND OF THE INVENTION

The invention relates to a sharpener for sharpening a cutting tool, such as a knife, the sharpener comprising a body part, a rotatable sharpening roll supported by the body part, and a first guide groove above the sharpening roll for receiving a blade of a first tool and for guiding it in relation to the sharpening roll.

Such a sharpener for sharpening household knives is commonly known. When the blade of a knife to be sharpened is placed into the groove of the sharpening roll and the blade is moved a number of times back and forth in relation to the body part of the sharpener, the sharpening roll, at the same time as it rotates, sharpens the blade of the tool. For the sharpening to be carried out correctly and for the blade to be sharpened rapidly and easily, the blade of the tool to be sharpened must be at a specific angle to the groove of the sharpening roll. To facilitate the placing of the blade to the correct angle in relation to the sharpening roll, the sharpener comprises a wedge-like guide groove above the sharpening roll for receiving the blade and guiding it to the correct angle. The guide groove keeps the blade in the correct position when the blade is moved back and forth on the sharpening roll. If the guide groove is made too wide, i.e., there is a gap that is too large between the guide groove and the blade side, it is possible that the blade to be sharpened sets inclined at a wrong angle in relation to the sharpening roll, in which case the blade to be sharpened becomes lopsided. This means that for narrow blades, a narrow guide groove must be provided.

As is understood from the above disclosure, a sharpener designed for narrow blades must have a guide groove that is narrow enough so that a wider blade, such as an axe blade, becomes tightly wedged to the walls of the guide groove and the portion of the blade to be sharpened does not reach the groove of the sharpening roll. Thus, sharpening is naturally impossible. In fact, because of this there are sharpeners with a wider guide groove for axes and wide blades than in sharpeners designed for knives. Such sharpeners for axes cannot be used without problems—for the above reasons—for sharpening knives.

BRIEF DESCRIPTION OF THE INVENTION

It is an object of the invention to provide an easy to use and structurally simple sharpener that is applicable for sharpening both narrow blades, such as knife blades, and wide blades, such as axe blades, without a need for two separate sharpeners.

For this to be achieved, the invention provides for use a sharpener for sharpening a cutting tool, such as a knife, the sharpener comprising a body part, a rotatable sharpening roll supported by the body part, and a first guide groove above the sharpening roll for receiving a blade of a first tool and for guiding it in relation to the sharpening roll, the sharpener further comprising a second guide groove, which is wider than the first guide groove, to be arranged above the sharpening roll to allow a blade of a second tool to be received and guided in relation to the sharpening roll.

The invention is based on an idea of providing one and the same sharpener with guide grooves of different width, which grooves can be positioned at a desired location above one and the same sharpening roll for guiding a blade in relation to the appropriate sharpening roll. This allows the one and the same sharpening roll to be utilized for sharpening both narrow blades and wide blades. The narrower one of the guide grooves is arranged above the sharpening roll when a narrow blade is to be sharpened and guided, and the larger one of the guide grooves is arranged above the sharpening roll when a wider blade is to be sharpened and guided.

The sharpener preferably comprises a frame part movable in relation to the body part and provided with the first guide groove and the second guide groove, the frame part being preferably further movable in relation to the body part optionally between a first and a second position, a first guide groove thereof being above the sharpening roll in the first position and in the second position its second guide groove is above the sharpening roll.

The body part is preferably fastened to an outer cover which surrounds the frame part, the outer cover being provided with an opening setting above the body part, the opening having a width larger than that of the second guide groove, and by moving the frame part in relation to the body part optionally the first guide groove or the second guide groove are placeable at the opening to allow the tool to enter the guide groove at the opening, the outer cover being arranged to cover the one of the guide grooves not placed at the opening. This type of outer cover prevents the tool from being accidentally placed into a guide groove that is not above the sharpening roll and, at the same time, prevents the bottom of the groove in question from being damaged by a blade hitting it or in some other way coming into contact with it.

The outer cover is preferably tubular and arranged to guide the movement of an inner body between the first and the second positions. A tubular outer cover is easy to get a hold of when the sharper is used. In addition, the tubular outer cover is easy to manufacture.

The sharpener preferably comprises positioning means for positioning the inner body under a spring or magnetic load optionally to the first position or the second position. When the frame part is under spring load or magnet load in one of the positions of use, the spring load keeps it in the desired place in relation to the sharpening roll. An advantage of an embodiment in which the loading takes place by a magnetic force is that the moving of the sharpener from one position of use to another is more silent than if a spring is used for implementing the movement.

The preferred embodiments of the sharpener are disclosed in the accompanying claims.

Major advantages of the sharpener of the invention is that is allows blades of different thicknesses to be easily sharpened and yet the sharpener is structurally simple and easy to use.

BRIEF DISCLOSURE OF THE FIGURES

The invention will now be described in greater detail with reference to two preferred embodiments thereof and to the accompanying drawings, in which FIG. 1 is a side view of a first embodiment of a sharpener of the invention in a first position of use for sharpening a knife;

DETAILED DISCLOSURE OF THE INVENTION

Figure 1:
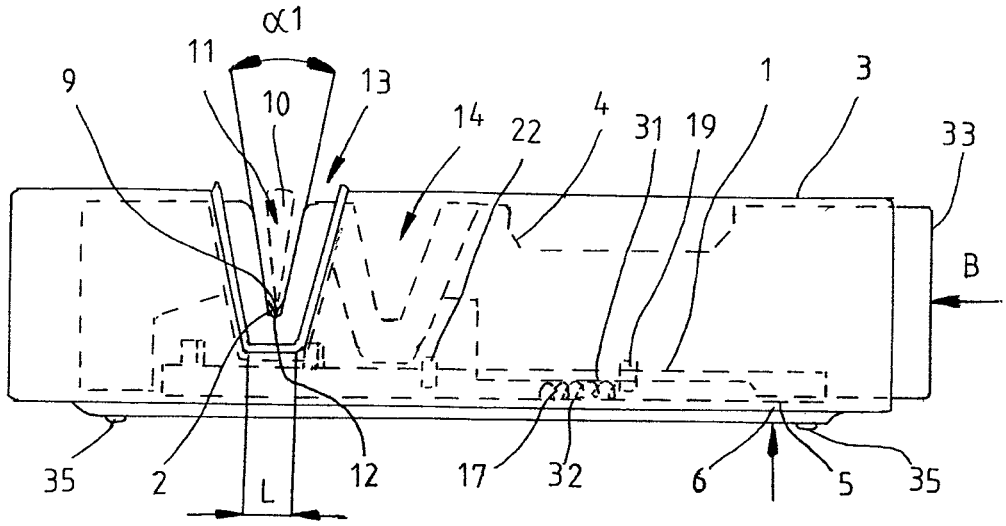
Figure 3:
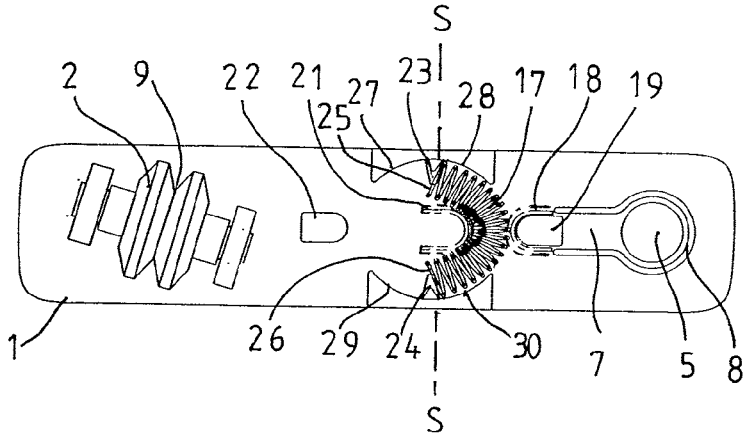
FIG. 3 is a top view of a body part of the sharpener of FIG. 1 with the sharpener in the first position of use corresponding to FIG. 1.

The sharpener of the invention as shown in FIG. 1 comprises a body part 1 depicted by a broken line in the figure and having a sharpening roll 2 mounted thereto on bearings. The sharpening roll 2 is a roll of a ceramic material and comprises a wedge-like groove 9 for receiving a blade 10 to be sharpened. The sharpening roll 2 and the groove 9 are best seen in FIG. 3. The body part 1 is surrounded by a longitudinal tubular outer cover 3, which covers the body part, and therefore only a small portion of the sharpening roll 2 (a portion of the sharpening roll groove) is visible in FIG. 1. Inside the outer cover 3 there is arranged a frame part 4 which is depicted by a broken line and may be referred to as an inner body, its structure being described further below.

The body part 1 is attached to the bottom of the outer cover 3 by means of a resilient locking stud 5. The bottom of the outer cover 3 is provided with a hole 6 for receiving the locking stud 5. When the body part 1 is attached to the outer cover 2, the locking stud 5 is surrounded by the hole 6 and the walls of the hole 6 prevent the body part 1 from moving in relation to the outer cover 3. If the body part 1 is to be removed from the outer cover 3, the stud 5 is pressed through the hole 6 in the direction of arrow A to such an extent that it is released from the hole 6, after which the body part 1 may be moved in a longitudinal direction of the outer cover 3 and be removed from the outer cover. The locking stud 5 has been rendered flexible by connecting it to the bottom of the body part 1 by a flexible neck part 7. The body part 1 with its neck part 7 and stud 5 is made of plastic as a single piece. The neck part 7 is flexible because it is narrow and thin. The stud 5 and the neck part 7 are surrounded by a gap 8 similar to a key hole.

The frame part 4 comprises a wedge-like guide groove 11 for receiving a blade 10 to be sharpened and for guiding it against the groove 9 of the sharpening roll 2 (the groove 9 is well visible in FIG. 3). The guide groove 11 is meant to guide the blade 10 to a correct angle in relation to the sharpening roll 2 and to keep the blade 10 at the correct angle in relation to the sharpening roll when the sharpener is being used. The guide groove 11 has an angle $\alpha 1$ which is 10 to 20 degrees, preferably about 15 degrees. A tip 12 of the guide groove 11, i.e. the bottom of the guide groove 11, sets at a height that leaves about 20 to 30% of the sharpening roll 2 visible when the sharpener is viewed from the angle of FIG. 1, i.e. from the side. Accordingly, if the sharpening roll 2 has a diameter of 20 mm, 4 to 6 mm of the sharpening roll will remain visible. The width of the guide groove 11 at the tip is about 1 mm when seen from the side. The width and the angle $\alpha 1$ of the guide groove 11 are selected so that an empty space of about 2 to 4 mm at the most is left between a guide groove wall and either one of the sides of the blade 10 even if the blade was not exactly vertical. The length of the guide groove 11 in cross-direction to the sharpener is 30 mm and preferably within a range of 25 to 35 mm. The guide groove 11 is accessible through an opening 13 made to the outer cover 3. In the sharpener of the figures the opening 13 is upward widening and has a spread angle that basically corresponds to the angle $\alpha 1$ of the guide groove 11. The opening 13 has a bottom width L of 5 to 10 mm. The shape and size of the opening 13 may differ from those presented.

Figure 2:
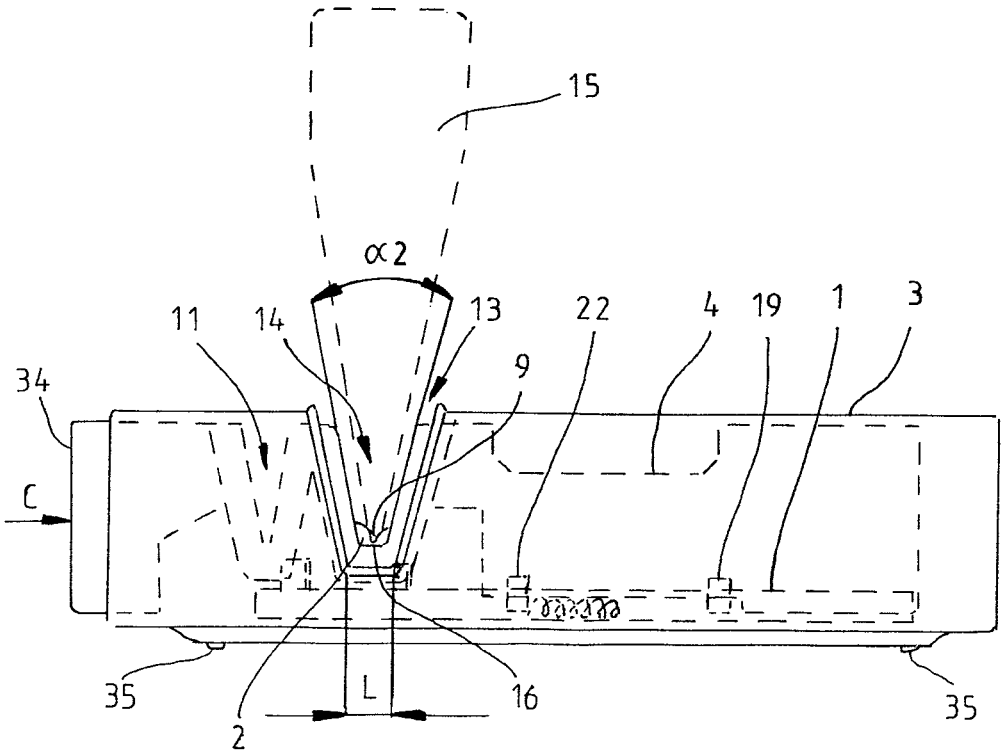
FIG. 2 is a side view of the sharpener of FIG. 1 in a second position of use for sharpening an axe.

The frame 4 part is movable in a longitudinal direction of the body part 1 so that it is placeable from the position of FIG. 1 to the position of FIG. 2, in which the guide groove 11 remains hidden inside the outer cover 3. In FIG. 2 the inner body contains a second wedge-like guide groove 14 which sets at the opening 13 of the outer cover above the sharpening roll 2. The guide groove 14 is wider than the guide groove 11 so as to be able to receive a blade 15 of an axe depicted with a broken line, i.e. a blade that is significantly wider than the blade 10 in FIG. 1. The axe blade 15 would not fit into the guide groove 11 of FIG. 1 but would be wedged to its walls. The guide groove 14 has an angle $\alpha 2$ corresponding to the angle $\alpha 1$ of the guide groove 11. The tip 16 of the guide groove 14 sets at a height that leaves about 20 to 30% of the sharpening roll 2 visible when the sharpener is seen from the view angle of FIG. 2. The width of the guide groove 13 at the tip 16 is 2 to 3 mm. The width is significantly greater than the width of the guide groove 11. It will be understood from FIGS. 1 and 2 that the opening 13 of the outer cover 3 must be wider than the width of the guide groove 14 and also that of the guide groove 11.

When the frame part 4 is in the position shown in FIG. 1, it is loaded by a compression spring 17 through a stopper member 18 of the frame part, against a stopper member 19 of the body part 1, see FIG. 3. In FIG. 1 there is also a compression spring 17 drawn to illustrate its location and position when the frame part 4 is in the position of FIG. 1. For the sake of simplicity FIG. 3 shows only the stopper members 18, 21 of the frame part 4 (inner body) drawn with a broken line.

Figure 4:
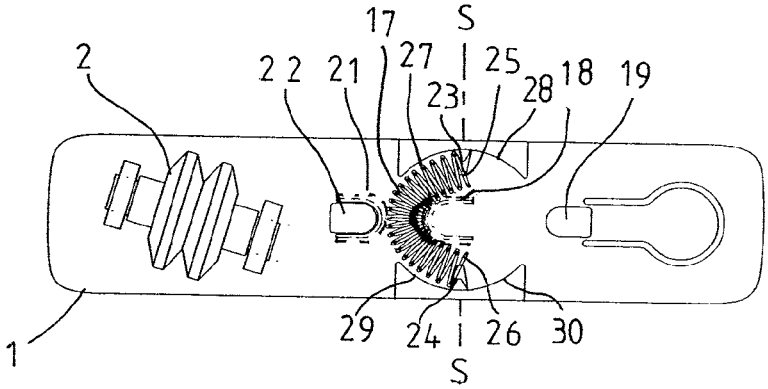
FIG. 4 is a top view of the body part of the sharpener of FIG. 2 with the sharpener in the second position of use corresponding to FIG. 2.

When the frame part 4 is in the position shown in FIG. 2, it is loaded by a compression spring 17 through a stopper member 21 of the frame part against a stopper means 21 of the frame part, see FIG. 4. In FIG. 2 there is also a compression spring 17 drawn to illustrate its location and position when the frame part 4 is in the position of FIG. 2. For the sake of simplicity FIG. 4 shows only the stopper members 18, 21 of the frame part 4 (inner body) drawn with a broken line.

The compression spring 17 keeps the frame part 4 spring-loaded either in positions of FIGS. 1 and 3, or in those of FIGS. 2 and 4, and the guide grooves 11 and 14 remain at the desired place above the sharpening roll 2 at locations depicted in FIGS. 1 and 2 when the sharpener is used for sharpening.

The compression action in question of the compression spring 17 has been obtained by compressing it between protrusions 23 and 24 provided in the body part 1 and by allowing it to expand and curve to opposite lateral directions towards the stopper means 19 and 22. The compression spring 17 tends to expand towards the stopper means 19 of the body part 1 and to push the stopper member 18 towards the stopper means 19 of the body part, if an external force moves the compression spring to the right of line S-S defined by the protrusions 23, 24. FIG. 3 shows a situation in which the periphery of the compression spring 17 presses the stopper member 18 against the stopper means 19 of the body part 1. If an external force moves the compression spring 17 to the left of line S-S defined by the protrusions 23, 24, the compression spring tends to expand towards the stopper means 22 of the body part 1 and to push the stopper member 21 towards the stopper means 22 of the body part. FIG. 4 illustrates a situation in which the periphery of the compression spring 17 presses the stopper member 21 of the inner body against the stopper means 22 of the body part 1.

The protrusions 23 and 24 enter into ends 25, 26 of the compression spring 17 and thus prevent the compression spring 17 from coming loose from its biased, compressed state. Instead of the protrusions 23, 24, other kind of support means may be used for supporting the spring ends, such as recesses which the compression spring ends enter. Reference numerals 27 to 30 denote curved supports against which the periphery of the compression spring 17 may rest. In the case of FIG. 3 the periphery of the compression spring 17 rests against supports 28 and 30, and in the case of FIG. 4 against supports 27 and 29. The frame part 4 comprises a support surface 32 preventing the compression spring 17 from curving upward, see FIG. 1, and the bottom of the body part 1 comprises a support surface 32 preventing the compression spring 17 from curving downward, see FIG. 1. The compression spring 17 sets between the support surfaces 31 and 32. Between the stopper members 18 and 21 of the inner body there is a gap corresponding to the thickness of the compression spring 17 and hence there is no space left around the compression spring. This provides the compression spring 17 with a controlled support and the inner body 4 moves between the positions shown in FIGS. 1 and 2 in a controlled manner without a risk of the ends of the compression spring 17 getting loose from the protrusions 23, 24 of the body part 1.

The frame part 4 is made to move from the first position of FIG. 1 to the second position of FIG. 2 by pushing the frame part at the end 33 of the sharpener by an external force into the direction of arrow B. The external force subjected to the stopper member 18 during pushing must exceed the reverse-direction force subjected to the stopper member 18 by the compression spring 17 until the compression spring 17 reaches line S-S of the protrusions 23, 24, see FIG. 3. When the stopper member 18 has moved from the position of FIG. 3 to the left to the extent that the middle part of the compression spring 17 sets on line S-S defined by the protrusions 23, 24, the compression spring 17 begins to press the stopper member 21 towards the stopper means 22 of the body part, provided that the compression spring moves a bit further to the left from line S-S defined by the protrusions 23, 24, the spring force thus making the frame part 4 set into the position shown in FIG. 2. The spring force caused by the compression spring 17 keeps the frame part 4 in the position of FIG. 2.

The frame part 4 can be made to move from the second position shown in FIG. 2 to the first position shown in FIG. 1 by applying an external force to a frame part end 34 of the sharpener to push it towards arrow C. During the pushing, the external force acting on the stopper member 21 must exceed the reverse-direction force subjected to the stopper member 21 by the compression spring 17 until the compression spring 17 reaches line S-S of the protrusions 23, 24. When the stopper member 21 has moved from the position of FIG. 4 to the right to such an extent that the middle part of the compression spring 17 sets on line S-S defined by the protrusions 23, 24, the compression spring 17 starts to press the stopper member 18 towards the stopper means 19 of the body part, provided that the compression spring moves slightly more to the right from line S-S defined by the protrusions, the spring force thus making the frame part 4 return to the position of FIG. 1. The spring force keeps the frame part 4 in the position of FIG. 1.

Figure 5:
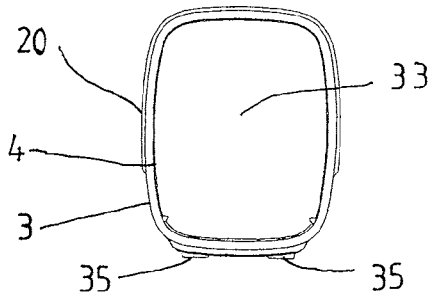
FIG. 5 shows the sharpener of FIG. 1 as seen from the direction of arrow B in FIG. 1.

FIG. 5 shows the sharpener from the other end. As is understood from the figure the tubular outer cover 3 acts as a guide means for the movement of the frame part 4. Reference numeral 20 indicates a reinforcement surrounding the opening 13 in the outer cover 3 and stiffening the outer cover 3.

Figure 6:
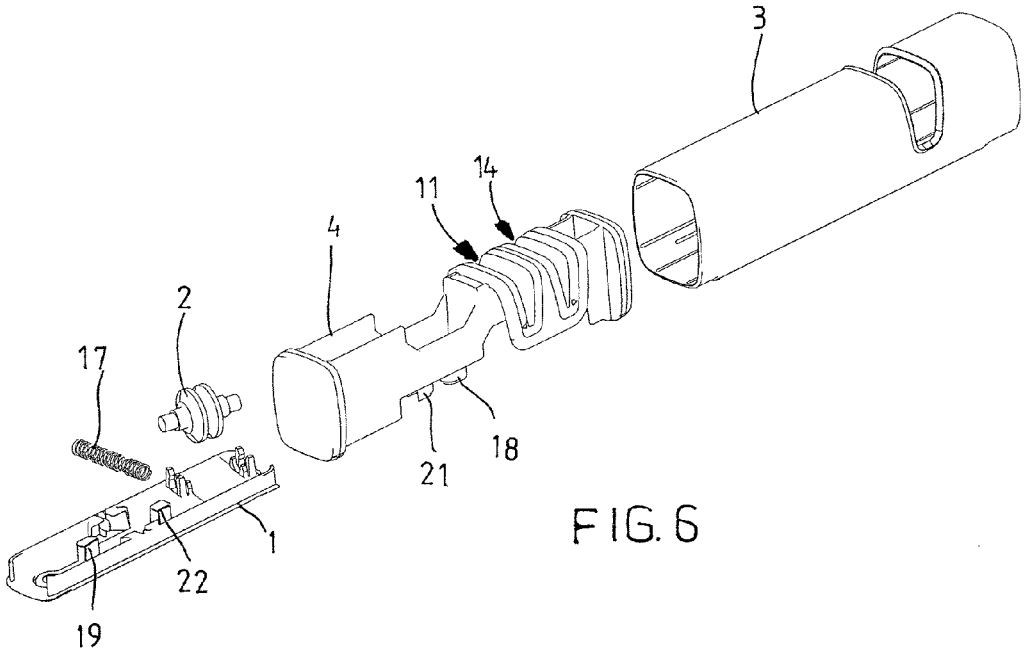
FIG. 6 is an explosive view of the sharpener of FIGS. 1 and 2.

FIG. 6 is an explosion view of the sharpener. The figure shows the components of the sharpener in detail.

The sharpener is made of plastic by injection moulding. The outer cover 3 is preferably a mixture of acrylonitrile butadiene styrene (ABS) and polycarbonate (PC). Alternatively, it may be ABS or PC, for example. In order to increase friction between the outer cover 3 and the base to facilitate the use of the sharpener, the bottom of the outer cover 3 is preferably provided with protrusions 35 made of an elastomer material; alternatively, the bottom of the outer cover 3 may be provided with a larger surface made of thermoplastic elastomer (TPE), i.e. a rubber-like thermoplast or a mixture of plastic and rubber. The body part 1 and the frame part 4 are preferably of ABS. Alternatively, they may be made of polypropylene (PP) or polyoxymethylene (POM), for example.

The sharpener is used by placing it onto a surface, by holding the outer cover 3 and pushing the blade 10 to be sharpened back and forth in the guide groove 11 or, if the blade 15 is wide, back and forth in the guide groove 14. The back and forth movement makes the sharpening roll 2 rotate and as the roll rotates it sharpens the blade 10, 15 of the tool.

Figure 7:
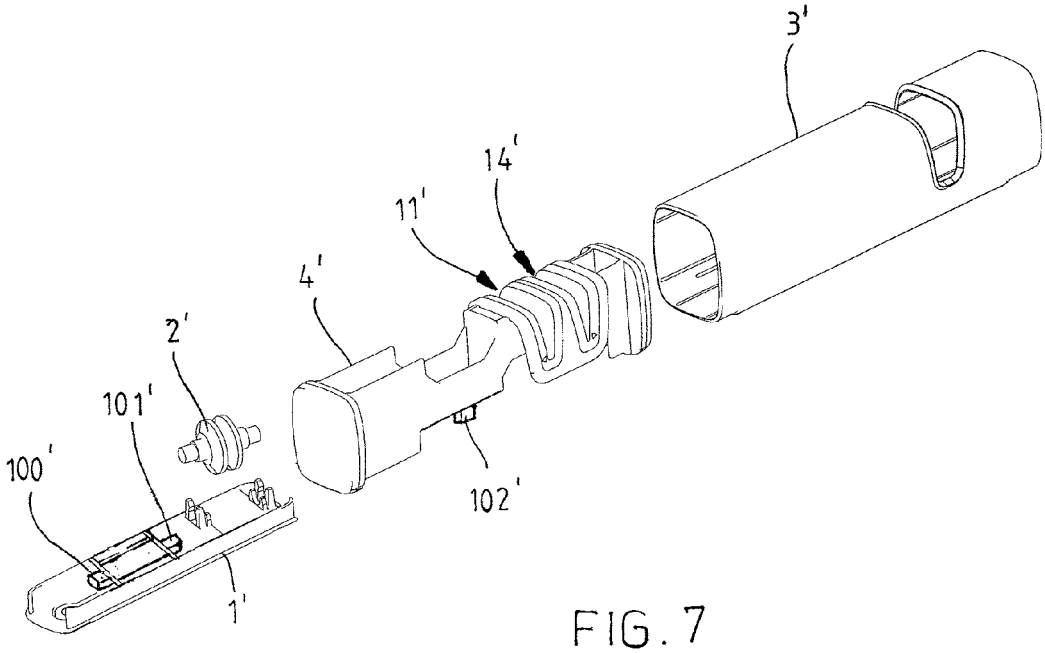
FIG. 7 is an explosive view of a second embodiment of the sharpener of the invention.
Figure 8:
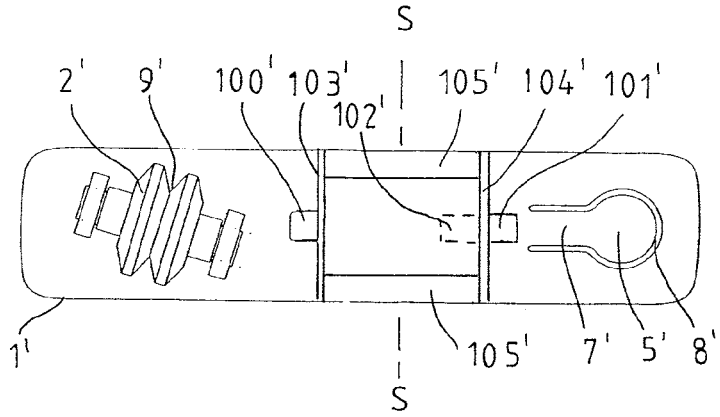
FIG. 8 is a top view of the body part of the sharpener of FIG. 7 with the sharpener in the first position of use corresponding to FIG. 1.
Figure 9:
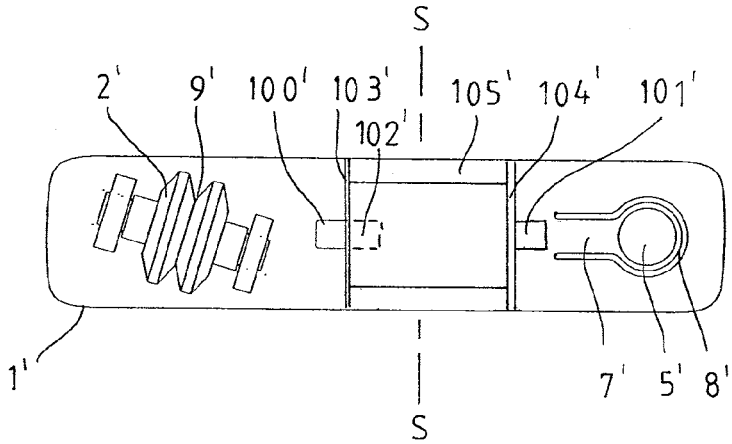
FIG. 9 is a top view of the body part of the sharpener of FIG. 7 with the sharpener in the second position of use corresponding to FIG. 10.

FIG. 7 shows a second embodiment of the sharpener of the invention. In the figure, like reference numerals are used as in FIG. 6 for like components. It is seen that in FIG. 7 the stopper members 18 and 21 of the frame part 4 of FIG. 6 are replaced by a pin-like part 102' (which is also a stopper member) and that the stopper means 100', 101' of the body part 1' of FIG. 7 look slightly different than the stopper means 19, 22 of FIG. 6. The pin-like part in FIG. 7 is a steel pin 102' and the stopper means 100', 101' are magnets. FIGS. 8 and 9 disclose the operation of the steel pin 102' and the magnets 100', 101'.

FIG. 8 corresponds to the view of FIG. 3. In FIG. 8 the steel pin 102' of the frame part (cf. the frame part 4' of FIG. 7) is against the magnet 101' of the body part 1' and keeps the frame part in a position in which its narrower groove 11' is above the sharpening roll 2'. In other words, in FIG. 8 the magnet 101' draws the steel pin 102' towards itself and keeps the frame part 4' in the first position by magnetic force. Reference numerals 103' and 104' depict partition walls supporting the magnets 100' and 101', respectively. Reference numerals 105' depict stiffener parts for stiffening the body part 1'.

Figure 10:
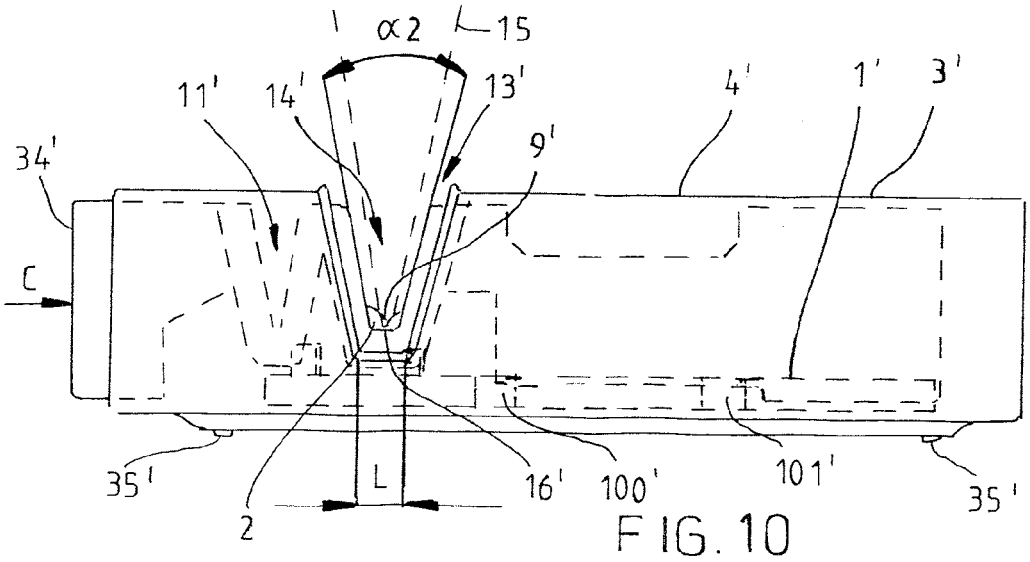
FIG. 10 shows the sharpener of FIG. 7 in the second position of use corresponding to FIG. 2 for sharpening an axe.

FIG. 9 corresponds to the view of FIG. 4. In FIG. 9, correspondingly, the steel pin 102' of the frame part (cf. the frame part 4 in FIGS. 7 and 10) is against the magnet 100' of the body part 1' and keeps the frame part in a position in which its wider groove 14' is above the sharpening roll 2'. FIG. 10 shows the position of use in question, which corresponds to the position of the frame part 4 in FIG. 2. Like reference numerals are used in FIG. 10 as in FIG. 2 for like components. According to embodiments of FIGS. 7 to 10, it is feasible to replace the magnets 100', 101' by steel pieces, in which case the steel pin 102' is replaced by a piece of magnet.

The invention has been presented above with reference to only two embodiments and it is therefore pointe out that the details of the invention may be implemented in various ways within the scope of the accompanying claims. Consequently, the shape of the sharpener, for example, may deviate from the one disclosed. The outer cover 3, 3' is not necessarily needed, although it is highly recommended, because it provides a number of advantages: it supports the frame part 4, 4' (to the inner body) and keeps the frame part against the body part 1, 1', it is easy to take hold of by hand when the sharpener is used and it allows the sharpener to be provided with an excellent outer appearance. The frame part 4, 4' does not need to be supported by a spring or a magnet in its different positions of use, although this is extremely recommendable from the point of view of use of the sharpener, because a spring or magnet support allows to provide the necessary lateral support of the blade 10, 15 to be sharpened against the walls of the guide grooves 11, 14. The guide grooves 11 and 14 do not necessarily have to be wedge-like, although a wedge shape is most preferable for supporting the blade to be sharpened. Instead of a ceramic sharpening roll, a diamond sharpening roll may be used.

The invention claimed is:

1. A sharpener for sharpening a cutting tool, such as a knife, the sharpener comprising:

a body part, a rotatable sharpening roll supported by the body part, a first guide groove above the sharpening roll for receiving a blade of a first tool and for guiding the blade of the first tool in relation to the sharpening roll, a second guide groove, which is wider than the first guide groove, to be arranged above the sharpening roll to allow a blade of a second tool to be received and guided in relation to the sharpening roll, a frame part movable in relation to the body part and having he first guide groove and the second guide groove arranged therein, the frame part being movable in relation to the body part optionally between a first and a second position, in the first position the first guide groove being above the sharpening roll and in the second position the second guide groove being above the sharpening roll, wherein the body part is attached to an outer cover surrounding the frame part, the outer cover having an opening above the body part, the opening having a width larger than the second guide groove, and whereby moving the frame part in relation to the body part, optionally the first guide groove or the second guide groove is placeable at the opening to allow the tool to enter the guide groove at the opening, the outer cover being arranged to cover the one of the guide grooves that is not placed at the opening.

2. A sharpener as claimed in claim 1, wherein the outer cover is tubular and arranged to guide the movement of the frame part between the first and the second position.

3. A sharpener as claimed in claim 2, which further comprises positioning means for placing the frame part loaded by spring force optionally to the first or the second position.

4. A sharpener as claimed in claim 3, wherein the outer cover is tubular and arranged to guide the movement of the frame part between the first and the second position.

5. A sharpener as claimed in any one of claims 2 to 4, which further comprises positioning means for placing the frame part loaded by spring force optionally to the first or the second position.

6. A sharpener as claimed in claim 5, wherein the positioning means comprise a spring arranged to press the frame part optionally against a first stopper means of the body part, when the frame part is in the first position, or against a second stopper means of the body part, when the frame part is in the second position.

7. A sharpener as claimed in claim 6, wherein the spring is a compression spring having ends that are set against support means so that the compression spring is subjected to compression, the support means being arranged to allow the ends of the compression spring to turn and, at the same time, the compression spring to curve to a curved shape curving to opposite directions, the compression spring being curved to a first direction when the frame part is in the first position and curved to a second direction away from the first direction when the frame part is in the second position, that the periphery of the spring is arranged to press the frame part against the first stopper means provided in the body part by a first stopper member associated with the frame part, when the spring is curved to the first direction, and the periphery of the spring is arranged to press the frame part against the second stopper means provided in the body part by a second stopper member associated with the frame part, when the compression spring is curved to the second direction, and in which sharpener the second stopper member associated with the frame part is arranged to turn the compression spring to the first direction when the frame part is moved to the first position, and the first stopper member associated with the frame part is arranged to turn the compression spring to the second direction, when the frame part is moved to the second position.

8. A sharpener as claimed in claim 7, wherein the support means are protrusions entering the ends of the compression spring.

9. A sharpener as claimed in claim 2, further comprising position means for positioning the frame part under a magnetic load optionally to the first positionor the second position.

10. A sharpener as claimed in claim 7, wherein the body part and the frame part comprise parallel support surfaces for preventing the compression spring from curving to a direction other than the first direction and the second direction.

11. A sharpener as claimed in claim 2 to 4, further comprising positioning means for positioning the frame part under a magnetic load optionally to the first position or the second position.

12. A sharpener as claimed in claim 11, wherein the positioning means comprise a stopper member made of a ferromagnetic material and arranged to the frame part, and by magnetic force the stopper member is arranged to press the frame part optionally towards the first stopper means of the body part, when the frame part is in the first position, or towards the second stopper means of the body part, when the frame part is in the second position.

13. A sharpener for sharpening a cutting tool, such as a knife, the sharpener comprising:

a body part, a rotatable sharpening roll supported by the body part, a first guide groove above the sharpening roll for receiving a blade of a first tool and for guiding the blade of the first tool in relation to the sharpening roll, a second guide groove, which is wider than the first guide groove, to be arranged above the sharpening roll to allow a blade of a second tool to be received and guided in relation to the sharpening roll, a frame part movable in relation to the body part and having the first guide groove and the second guide groove arranged therein, the frame part being movable in relation to the body part optionally between a first and a second position, in the first position the first guide groove being above the sharpening roll and in the second position the second guide groove being above the sharpening roll, and positioning means for positioning the frame part under a magnetic load optionally to the first position or the second position.

14. A sharpener as claimed in claim 13, wherein the positioning means comprise a stopper member made of a ferromagnetic material and arranged to the frame part, and by magnetic force the stopper member is arranged to press the frame part optionally towards the first stopper means of the body part, when the frame part is in the first position, or towards the second stopper means of the body part, when the frame part is in the second position.

15. A sharpener as claimed in claim 14, wherein the first stopper means of the body part is a magnet and that the second stopper means of the body part is a magnet.

16. A sharpener for sharpening a cutting tool, such as a knife, the sharpener comprising:

a body part, a rotatable sharpening roll supported by the body part, a first guide groove above the sharpening roll for receiving a blade of a first tool and for guiding the blade of the first tool in relation to the sharpening roll, a second guide groove, which is wider than the first guide groove, to be arranged above the sharpening roll to allow a blade of a second tool to be received and guided in relation to the sharpening roll, a frame part movable in relation to the body part and having the first guide groove and the second guide groove arranged therein, the frame part being movable in relation to the body part optionally between a first and a second position, in the first position the first guide groove being above the sharpening roll and in the second position the second guide groove being above the sharpening roll, positioning means for placing the frame part loaded by spring force optionally to the first or the second position, wherein the positioning means comprise a spring arranged to press the frame part optionally against a first stopper means of the body part, when the frame part is in the first position, or against a second stopper means of the body part, when the frame part is in the second position, and wherein the spring is a compression spring having ends that are set against support means so that the compression spring is subjected to compression, the support means being arranged to allow the ends of the compression spring to turn and, at the same time, the compression spring to curve to a curved shape curving to opposite directions, the compression spring being curved to a first direction when the frame part is in the first position and curved to a second direction away from the first direction when the frame part is in the second position, that the periphery of the spring is arranged to press the frame part against the first stopper means provided in the body part by a first stopper member associated with the frame part, when the spring is curved to the first direction, and the periphery of the spring is arranged to press the frame part against the second stopper means provided in the body part by a second stopper member associated with the frame part, when the compression spring is curved to the second direction, and in which sharpener the second stopper member associated with the frame part is arranged to turn the compression spring to the first direction when the frame part is moved to the first position, and the first stopper member associated with the frame part is arranged to turn the compression spring to the second direction, when the frame part is moved to the second position.

17. A sharpener as claimed in claim 16, wherein the support means comprise protrusions entering the ends of the compression spring.

18. A sharpener as claimed in claim 16, wherein the body part comprises curved guides for supporting the compression spring when it is curved to said different directions.

19. A sharpener as claimed in claim 16, wherein the body part and the frame part comprise parallel support surfaces for preventing the compression spring from curving to a direction other than the first direction and the second direction.

* * * * *

UNITED STATES PATENT AND TRADEMARK OFFICE

CERTIFICATE OF CORRECTION

PATENT NO. : 8,864,554 B2
APPLICATION NO. : 13/599888
DATED : October 21, 2014
INVENTOR(S) : Masalin et al.

It is certified that error appears in the above-identified patent and that said Letters Patent is hereby corrected as shown below:

In the Claims

1. In claim 1, column 7, line 25:

delete "he" and insert --the--

2. In claim 4, column 7, beginning at line 48:

delete "wherein the outer cover is tubular and arranged to guide the movement of the frame part between the first and the second position" and insert --wherein the positioning means comprise a spring arranged to press the frame part optionally against a first stopper means of the body part, when the frame part is in the first position, or against a second stopper means of the body part, when the frame part is in the second position.--

3. In claim 5, column 7, beginning at line 51:

delete "A sharpener as claimed in anyone of claims 2 to 4, which further comprises positioning means for placing the frame part loaded by spring force optionally to the first or the second position." and insert --A sharpener as claimed in claim 4, wherein the spring is a compression spring having ends that are set against support means so that the compression spring is subjected to compression, the support means being arranged to allow the ends of the compression spring to turn and, at the same time, the compression spring to curve to a curved shape curving to opposite directions, the compression spring being curved to a first direction when the frame part is in the first position and curved to a second direction away from the first direction when the frame part is in the second position, that the periphery of the spring is arranged to press the frame part against the first stopper means provided in the body part by a first stopper member associated with the frame part, when the spring is curved to the first direction, and the periphery of the spring is arranged to press the frame part against the second stopper means provided in the body part by a second stopper member associated with the frame part, when the compression spring is curved to the second direction, and in Signed and Sealed this
Fifth Day of July, 2016

Michelle K. Lee

Michelle K. Lee
*Director of the United States Patent and Trademark Office* which sharpener the second stopper member associated with the frame part is arranged to turn the compression spring to the first direction when the frame part is moved to the first position, and the first stopper member associated with the frame part is arranged to turn the compression spring to the second direction, when the frame part is moved to the second position.--

4. In claim 6, column 7, beginning at line 55:

delete "the positioning means comprise a spring arranged to press the frame part optionally against a first stopper means of the body part, when the frame part is in the first position, or against a second stopper means of the body part, when the frame part is in the second position" and insert --the support means are protrusions entering the ends of the compression spring.--

5. In claim 7, column 7, beginning at line 61:

delete "claim 6, wherein the spring is a compression spring having ends that are set against support means so that the compression spring is subjected to compression, the support means being arranged to allow the ends of the compression spring to turn and, at the same time, the compression spring to curve to a curved shape curving to opposite directions, the compression spring being curved to a first direction when the frame part is in the first position and curved to a second direction away from the first direction when the frame part is in the second position, that the periphery of the spring is arranged to press the frame part against the first stopper means provided in the body part by a first stopper member associated with the frame part, when the spring is curved to the first direction, and the periphery of the spring is arranged to press the frame part against the second stopper means provided in the body part by a second stopper member associated with the frame part, when the compression spring is curved to the second direction, and in which sharpener the second stopper member associated with the frame part is arranged to turn the compression spring to the first direction when the frame part is moved to the first position, and the first stopper member associated with the frame part is arranged to turn the compression spring to the second direction, when the frame part is moved to the second position." and insert --claim 5, wherein the body part comprises curved guides for supporting the compression spring when it is curved to said different directions.--

6. In claim 8, column 8, beginning at line 18:

delete "claim 7, wherein the support means are protrusions entering the ends of the compression spring." and insert --claim 5, wherein the body part and the frame part comprise parallel support surfaces for preventing the compression spring from curving to a direction other than the first direction and the second direction.--

7. In claim 9, column 8, beginning at line 21:

delete "position means for positioning the frame part under a magnetic load optionally to the first positionor the second position." and insert --positioning means for positioning the frame part under a magnetic load optionally to the first position or the second position.--

8. In claim 10, column 8, beginning at line 25:

delete "claim 7, wherein the body part and the frame part comprise parallel support surfaces for preventing the compression spring from curving to a direction other than the first direction and the second direction." and insert --claim 9, wherein the positioning means comprise a stopper member made of a ferromagnetic material and arranged to the frame part, and by magnetic force the stopper member is arranged to press the frame part optionally towards the first stopper means of the body part, when the frame part is in the first position, or towards the second stopper means of the body part, when the frame part is in the second position.--

9. In claim 11, column 8, beginning at line 29:

delete "2 to 4, farther comprising positioning means for positioning the frame part under a magnetic load optionally to the first position or the second position." and insert --10, wherein the first stopper means of the body part is a magnet and that the second stopper means of the body part is a magnet.--

10. In claim 12, column 8, beginning at line 33:

delete "11, wherein the positioning means comprise a stopper member made of a ferromagnetic material and arranged to the frame part, and by magnetic force the stopper member is arranged to press the frame part optionally towards the first stopper means of the body part, when the frame part is in the first position, or towards the second stopper means of the body part, when the frame part is in the second position." and insert --1, wherein the first guide groove and the second guide groove are wedge-like.--